US010877404B1

(12) United States Patent
Yamaki

(10) Patent No.: US 10,877,404 B1
(45) Date of Patent: Dec. 29, 2020

(54) TRANSFER DEVICE AND IMAGE FORMING APPARATUS

(71) Applicant: FUJI XEROX CO., LTD., Tokyo (JP)

(72) Inventor: Hiromoto Yamaki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/847,980

(22) Filed: Apr. 14, 2020

(30) Foreign Application Priority Data

Oct. 1, 2019 (JP) ..... 2019-181513

(51) Int. Cl.
*G03G 15/16* (2006.01)

(52) U.S. Cl.
CPC ..... *G03G 15/161* (2013.01); *G03G 15/168* (2013.01); *G03G 15/1615* (2013.01); *G03G 2215/1661* (2013.01)

(58) Field of Classification Search
CPC ..... G03G 15/161; G03G 15/1615; G03G 15/168; G03G 2215/1661
See application file for complete search history.

(56) References Cited

U.S. PATENT DOCUMENTS

2007/0230990 A1* 10/2007 Ogasawara ..... G03G 15/161 399/101
2017/0003628 A1* 1/2017 Fukazawa ..... G03G 15/1605
2017/0269513 A1* 9/2017 Kubo ..... G03G 15/162

FOREIGN PATENT DOCUMENTS

JP 2000-181313 A 6/2000

* cited by examiner

*Primary Examiner* — Sandra Brase
(74) *Attorney, Agent, or Firm* — Sughrue Mion, PLLC

(57) ABSTRACT

A transfer device includes first and second assemblies, a spring, and a moving mechanism. The first assembly is rotatable around a first rotation shaft. The first assembly includes an endless belt, and a transfer roller that presses a sheet against an image transport belt to transfer a toner image onto the sheet. The second assembly is rotatable around a second rotation shaft. The second assembly includes a cleaning blade that abuts a leading end edge thereof against a portion of the endless belt. The spring biases the second assembly to rotate around the second rotation shaft. The moving mechanism moves the transfer roller to be in contact with and separated from the image transport belt. The first assembly rotates around the first rotation shaft as the transfer roller moves. The second assembly follows the rotation of the first assembly to rotate around the second rotation shaft.

15 Claims, 3 Drawing Sheets

FIG. 4

| ANGLE α (°) BETWEEN WRAP START POSITION AND LEADING END OF BLADE | STAIN ON BACK SURFACE OF SHEET | OCCURRENCE STATE OF STAIN ON BACK SURFACE |
|---|---|---|
| 0 | X | NIP DEFECT DUE TO TENTION WRINKLE OF TRANSFER BELT |
| 10 | X | NIP DEFECT DUE TO TENTION WRINKLE OF TRANSFER BELT |
| 20 | O | |
| 30 | O | |
| 40 | Δ | NIP DEFECT DUE TO DECREASE OF OUTER DIAMETER OF TRANSFER BELT |
| 50 | Δ | NIP DEFECT DUE TO DECREASE OF OUTER DIAMETER OF TRANSFER BELT |

TRANSFER DEVICE AND IMAGE FORMING APPARATUS

CROSS-REFERENCE TO RELATED APPLICATIONS

This application is based on and claims priority under 35 USC 119 from Japanese Patent Application No. 2019-181513 filed Oct. 1, 2019.

BACKGROUND

1. Technical Field

The present disclosure relates to a transfer device and an image forming apparatus.

2. Related Art

Devices are known that clean a running belt by abutting a leading end edge of a cleaning blade against the belt. For example, JP-A-2000-181313 discloses a structure in which a belt and a cleaning blade are brought into contact with and separated from each other by moving an opposing member that faces the cleaning blade across the belt.

SUMMARY

A transfer device is known in which an endless belt is wound around a transfer roller, the transfer roller is pressed against an intermediate transfer belt, a sheet is sandwiched between the intermediate transfer belt and the endless belt, and a toner image on the intermediate transfer belt is transferred onto the sheet. The transfer device has a structure in which the transfer roller is moved to be in contact with and separated from the intermediate transfer belt in accordance with a thickness of the sheet, so as to adjust contact pressure between the intermediate transfer belt and the endless belt.

Here, consider removing stains on the endless belt of the transfer device with the cleaning blade.

When the cleaning blade is pressed against the endless belt, a backing member is required on a back side of the endless belt such that the endless belt is sandwiched. Here, the transfer roller is used as the backing member. The transfer roller is moved to be in contact with and separated from the intermediate transfer belt. For this reason, it is necessary to move the cleaning blade as the movement of the transfer roller.

In this case, a structure may be conceived in which a support member that integrally supports the transfer roller and the cleaning blade is provided and the transfer roller is moved by moving the support member. With this structure, the cleaning blade moves together with the transfer roller.

However, in the case of this structure, the support member is large in size, and it is necessary to keep the large support member movable, which may increase a size of the whole transfer device.

Aspects of non-limiting embodiments of the present disclosure relate to a transfer device that is downsized as compared with a structure in which a transfer roller and a cleaning blade are integrally supported.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a transfer device including a first assembly, a second assembly, a spring, and a moving mechanism. The first assembly is configured to be rotatable around a first rotation shaft. The first assembly includes an endless belt, and a transfer roller around which the endless belt is wound. An image transport belt is configured to carry and transport a toner image on a front surface. The transfer roller is configured to press a sheet against the image transport belt with the sheet being sandwiched between the image transport belt and the endless belt, so as to transfer the toner image on the image transport belt onto the sheet while rotating. The second assembly is configured to be rotatable around a second rotation shaft. The second assembly includes a cleaning blade having a plate shape. A leading end edge of the cleaning blade is abutted against a portion of the endless belt where the endless belt is wound around the transfer roller, so as to clean a front surface of the endless belt that is brought into contact with the sheet. The spring is configured to bias the second assembly to rotate around the second rotation shaft so as to press the leading end edge of the cleaning blade against the endless belt. The moving mechanism is configured to move the transfer roller to be in contact with and separated from the image transport belt. The first assembly rotates around the first rotation shaft as the transfer roller moves. The second assembly follows the rotation of the first assembly by the spring biasing the second assembly, so as to rotate around the second rotation shaft.

BRIEF DESCRIPTION OF THE DRAWINGS

Exemplary embodiment(s) of the present disclosure will be described in detail based on the following figures, wherein:

FIG. 4 is a table showing evaluation results of stain on a back surface of a sheet at each angle $\alpha$.

DETAILED DESCRIPTION

Hereinafter, exemplary embodiments of the present disclosure will be described.

Figure 1:
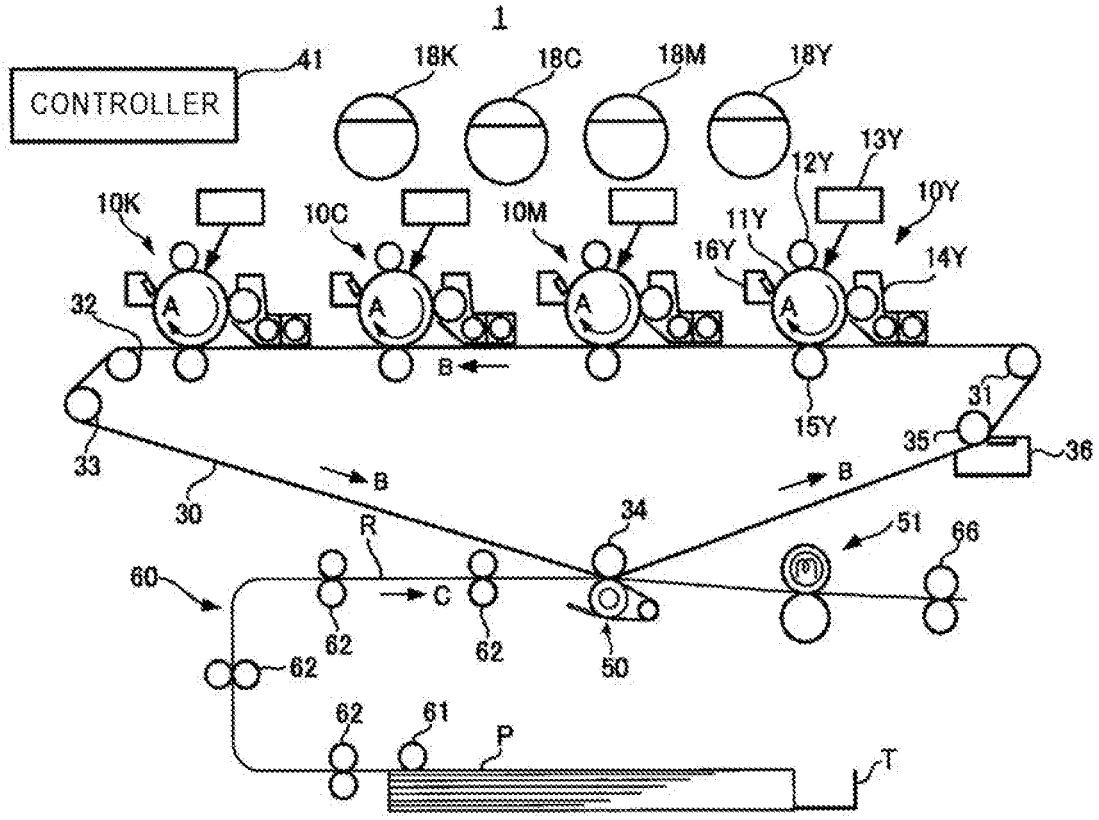
FIG. 1 is a configuration diagram showing an image forming apparatus according to an exemplary embodiment of the present disclosure.

FIG. 1 is a configuration diagram showing an image forming apparatus according to an exemplary embodiment of the present disclosure.

An image forming apparatus 1 shown in FIG. 1 is a tandem color printer including four image engines 10Y, 10M, 10C, 10K that form toner images with respective colors of yellow (Y), magenta (M), cyan (C) and black (K). This color printer has an ability to print a monochrome image and an ability to print a full-color image by superimposing the toner images of the four colors.

The image forming apparatus 1 includes toner cartridges 18Y, 18M, 18C, 18K that contains toners of the respective YMCK colors.

The image forming apparatus 1 includes an intermediate transfer belt 30, a fixing unit 51, a sheet transport unit 60, and a controller 41 that controls the respective units of the image forming apparatus 1.

Since the four image engines 10Y, 10M, 10C, 10K have the same configuration except for used developer, the image engine 10Y corresponding to yellow will be described as a representative example. The image engine 10Y includes an image carrier 11Y, a charging unit 12Y, an exposure unit 13Y, a developing unit 14Y, a primary transfer unit 15Y and an image carrier cleaner 16Y.

The image carrier 11Y has a photoconductive material layer on a cylindrical surface, carries an image formed on the surface, and rotates in a direction of an arrow A around an axis of a cylinder. The charging unit 12Y, the exposure unit 13Y, the developing unit 14Y, the primary transfer unit 15Y and the image carrier cleaner 16Y are sequentially disposed around the image carrier 11Y.

The charging unit 12Y charges the surface of the image carrier 11Y by applying a bias voltage. The charging unit 12Y of the present exemplary embodiment is a charging roller that is in contact with the surface of the image carrier 11Y. A voltage having the same polarity as charging polarity of the toner in the developing unit 14Y is applied to the charging roller, so that the surface of the image carrier 11Y that is in contact with the charging roller is charged. As the charging unit 12Y, a corona discharger that is not in contact with the image carrier 11Y may be employed in place of the charging roller.

The exposure unit 13Y exposes the surface of the image carrier 11Y by irradiating the image carrier 11Y with laser light in accordance with an image signal of a corresponding color (here, yellow). This image signal is generated by the controller 41 based on image data supplied from outside the image forming apparatus 1. An electrostatic latent image is formed on the surface of the image carrier 11Y by the exposure unit 13Y performing exposure. As the exposure unit 13Y, an LED array having a lot of LEDs arranged along a scanning direction may be employed in place of one using the laser light.

With a so-called two-component developer containing a toner and a magnetic carrier, the developing unit 14Y develops the electrostatic latent image on the surface of the image carrier 11Y to form a toner image. The toner is supplied from the toner cartridge 18Y to the developing unit 14Y. The developing unit 14Y charges the toner by agitating the developer inside the developing unit 14Y. It is noted that a so-called external additive may be added to the toner to enhance fluidity and charging property of the toner.

The primary transfer unit 15Y faces the image carrier 11Y across the intermediate transfer belt 30. A voltage having polarity opposite to the charging polarity of the toner is applied to the primary transfer unit 15Y, so that the primary transfer unit 15Y electrostatically attracts the toner image on the image carrier 11Y onto the intermediate transfer belt 30.

The image carrier cleaner 16Y scrapes a residual toner, the external additives, paper dust, and the like on the surface of the image carrier 11Y with a cleaning blade that is in contact with the surface of the image carrier 11Y, so as to clean the surface of the image carrier 11Y after transfer.

The intermediate transfer belt 30 is an endless belt, is stretched over belt support rollers 31 to 35, and circulates in a direction indicated by an arrow B via the image engines 10Y, 10M, 10C, 10K and the secondary transfer unit 50. The toner images of the colors are transferred from the image engines 10Y, 10M, 10C, 10K to the intermediate transfer belt 30 to overlap each other, so that a color toner image is formed. The intermediate transfer belt 30 carries the toner image and circulates in the direction indicated by the arrow B to deliver the toner image to the secondary transfer unit 50.

The sheet transport unit 60 takes out a sheet P accommodated in a sheet tray T with a pickup roller 61, and transports the sheet, with transport rollers 62, in a direction of an arrow C to the secondary transfer unit 50 along a sheet transport path R.

The secondary transfer unit 50 is a roller that is rotated with the intermediate transfer belt 30 and the sheet being sandwiched between the secondary transfer unit 50 and a backup roller 34 which is one of the belt support rollers 31 to 35. A voltage having polarity opposite to the charging polarity of the toner is applied to the secondary transfer unit 50, so that the secondary transfer unit 50 electrostatically attracts the toner image on the intermediate transfer belt 30 onto the sheet to form an unfixed toner image on the sheet. This secondary transfer unit 50 corresponds to an example of a transfer device of the present disclosure. The intermediate transfer belt 30 corresponds to an example of an image transport belt of the present disclosure. Details will be described later.

A belt cleaner 36 brings a blade into contact with the intermediate transfer belt 30 which has passed through the secondary transfer unit 50, so as to scrape the toner, the external additives, the paper dust, and the like on the intermediate transfer belt 30.

The fixing unit 51 fixes the unfixed toner image on the sheet by heat and pressure.

The sheet on which the toner image is fixed is discharged out of the apparatus by discharge rollers 66 that are a part of the sheet transport unit 60.

Figure 2:
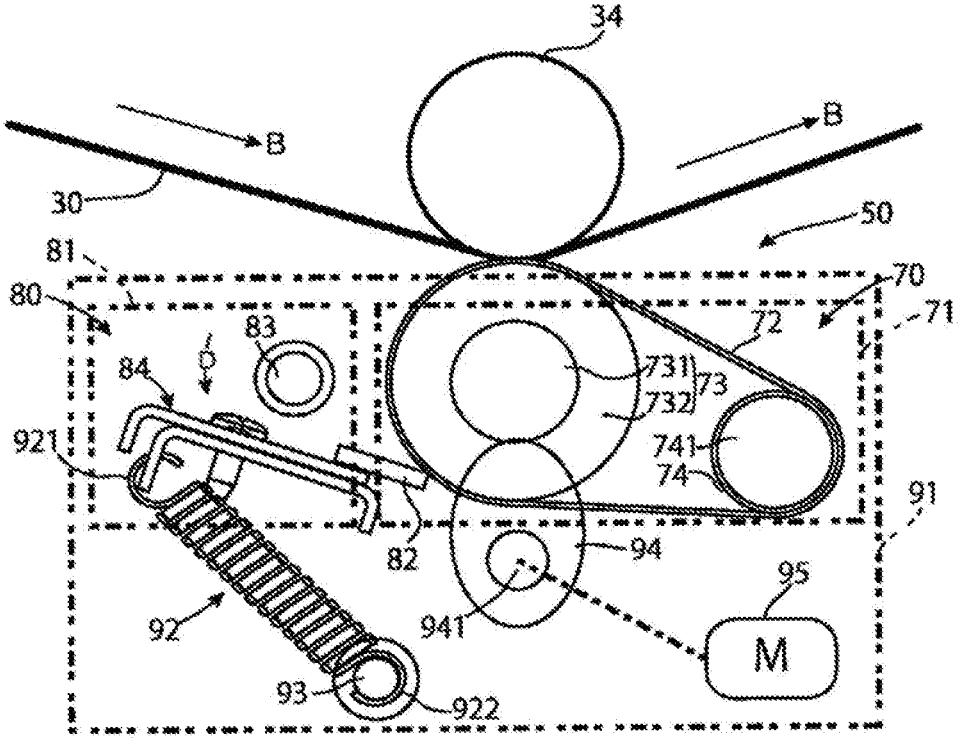
FIG. 2 is a schematic diagram showing a structure of a secondary transfer unit.

FIG. 2 is a schematic diagram showing a structure of the secondary transfer unit.

The secondary transfer unit 50 includes a first assembly 70 and a second assembly 80.

The first assembly 70 and the second assembly 80 are respectively assembled on a first frame 71 and a second frame 81. The first assembly 70 and the second assembly 80 are supported by a third frame 91 so as to be rotatable.

The first assembly 70 includes a transfer belt 72, a transfer roller 73, and a tension applying roller 74.

The transfer belt 72 corresponds to an example of an endless belt of the present disclosure. The transfer belt 72 of the present exemplary embodiment is a rubber belt, and is wound around the transfer roller 73 and the tension applying roller 74.

The transfer roller 73 is rotatably supported by the first frame 71. The transfer roller 73 presses the transfer belt 72 against the intermediate transfer belt 30. Then, when the sheet is transported, the transfer roller 73 presses the sheet against the intermediate transfer belt 30 to transfer the toner image on the intermediate transfer belt 30 onto the sheet P. The transfer roller 73 moves up and down in accordance with a thickness of the sheet used in forming an image, so as to adjust force of pressing the transfer belt 72 against the intermediate transfer belt 30. The transfer roller 73 of the present exemplary embodiment is a foam roller in which a periphery of a rotation shaft 731 is made of a foam body 732.

The tension applying roller 74 is also rotatably supported by the first frame 71. Then, this tension applying roller 74 applies tension to the wound transfer belt 72.

The first assembly 70 is supported by the third frame 91 so as to be rotatable around a rotation shaft 741 of the tension applying roller 74. The rotation shaft 741 of the tension applying roller 74 corresponds to an example of a first rotation shaft of the present disclosure.

The second assembly 80 is provided with a cleaning blade 82. The cleaning blade has a plate shape. A leading end edge of the cleaning blade is abutted against a portion of the transfer belt 72 where the transfer belt 72 is wound around the transfer roller 73, to clean a front surface of the transfer belt 72 that is brought into contact with the sheet. The second frame 81 constituting the second assembly 80 is supported by the third frame 91 so as to be rotatable around a rotation shaft 83 that is closer to the intermediate transfer belt 30 than the cleaning blade 82. Therefore, when the second frame 81 rotates around the rotation shaft 83, the cleaning blade 82 also moves around the rotation shaft 83. The rotation shaft 83 corresponds to an example of a second rotation shaft of the present disclosure.

The cleaning blade 82 is pasted and fixed to a support member 84. Then, the support member 84 is fixed to the second frame 81.

Here, an extension spring 92 is provided. A first end portion 921 of this extension spring 92 is supported by the support member 84 which supports the cleaning blade 82. A second end portion 922 of the extension spring 92 is supported by a boss 93 fixed to the third frame 91. Since the extension spring 92 pulls the support member 84, the second assembly 80 is biased to rotate around the rotation shaft 83 in a direction of an arrow D, so that the leading end edge of the cleaning blade 82 is pressed against the transfer belt 72.

Here, a cam member 94 and a motor 95 are shown.

The cam member 94 is rotatably supported by the third frame 91. The motor 95 is also supported by the third frame 91. This motor 95 rotates the cam member 94 around a rotation shaft 941 thereof. The transfer roller 73 is affected by the cam member 94 such that the transfer roller 73 moves up and down in response to rotation of the cam member 94. Then, the transfer roller 73 moves up and down so that the first assembly 70 rotates around the rotation shaft 741 of the tension applying roller 74. The cam member 94 corresponds to an example of a moving mechanism of the present disclosure.

The second assembly 80 is biased in the direction of the arrow D by the extension spring 92. Thus, when the transfer roller 73 moves up and down, the second assembly 80 follows the movement of the transfer roller 73 so as to rotate around the rotation shaft 83, and keeps pressing the cleaning blade 82 against the transfer belt 72.

Here, in order to move the transfer roller 73 up and down, it is conceivable to integrally assemble the secondary transfer unit 50 as a whole and move the integrally assembled secondary transfer unit 50 up and down as a whole. However, in the present exemplary embodiment, the first assembly 70 and the second assembly 80 are separated from each other. In order to move the transfer roller 73 moves up and down, the first assembly 70 is driven, and the second assembly 80 follows the first assembly 70. Accordingly, it is possible to provide the secondary transfer unit 50 that is downsized as compared with a structure in which the transfer roller 73 and the cleaning blade 82 are integrally supported.

In the present exemplary embodiment, the rotation shaft 83 of the second assembly 80 is closer to the intermediate transfer belt 30 than the cleaning blade 82. Even when the rotation shaft 83 is located at a position farther from the intermediate transfer belt 30 than the cleaning blade 82, the cleaning blade 82 can be pressed against the transfer belt 72 by the extension spring 92. In the present exemplary embodiment, the rotation shaft 83 of the second assembly 80 is closer to the intermediate transfer belt 30 than the cleaning blade 82, so the secondary transfer unit 50 is downsized as compared with a case where the rotation shaft 83 is located at the position farther from the intermediate transfer belt 30 than the cleaning blade 82.

In the present exemplary embodiment, the rubber belt is used as the transfer belt 72. Therefore, image quality deterioration due to the transferred toner image is prevented as compared with a case where the transfer belt 72 is made of a material having poor elasticity.

In the present exemplary embodiment, the foam roller is employed as the transfer roller 73. Therefore, the image quality deterioration due to the transferred toner image is prevented as compared with a case where a rigid transfer roller is employed.

Figure 3:
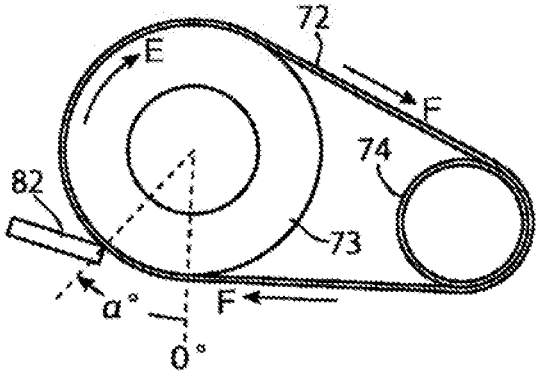
FIG. 3 is a schematic diagram showing members of the secondary transfer unit.

FIG. 3 is a schematic diagram showing members of the secondary transfer unit. Here, a position where the cleaning blade 82 is abutted against the transfer belt 72 will be discussed.

The transfer roller 73 rotates in a direction of an arrow E, and the transfer belt 72 circulates in a direction of an arrow F. Here, it is assumed that the most upstream position in the rotation direction of the transfer roller 73 in a region where the transfer belt 72 is in contact with the transfer roller 73, that is, a wrap start position is an origin point of a rotation phase of the transfer roller 73, that is, a point having a phase of 0 degree.

Since the transfer roller 73 is used as a backing member, the leading end edge of the cleaning blade 82 is abutted against a portion of the transfer belt 72 where the transfer belt 72 is wrapped by the transfer roller 73. Here, it is assumed that a phase of a point where the leading end edge of the cleaning blade 82 is abutted against the transfer belt 72, that is, an angle between the wrap start position and the leading end of the blade is $\alpha$ degree.

FIG. 4 is a table showing evaluation results of stain on a back surface of a sheet at each angle $\alpha$ degree.

Tension is applied to the transfer belt 72 by the tension applying roller 74. For this reason, a wrinkle is formed on a portion of the transfer belt 72 where the transfer belt 72 is not in contact with the transfer roller 73. The wrinkle is eliminated when the transfer belt 72 comes into contact with the transfer roller 73. However, when $\alpha$ is 0 degree or about 10 degrees, the wrinkle is not completely eliminated but still remains on the transfer belt 72. For this reason, the cleaning blade 82 has a nip defect, that is, is in a state where the cleaning blade 82 cannot be firmly abutted against the transfer belt 72. As a result, the transfer belt 72 is poorly cleaned, and the back surface of the sheet with which the transfer belt 72 contacts is stained. When $\alpha$ is 20 degrees or more, the wrinkle of the transfer belt 72 is eliminated, and thus there is no influence of the wrinkle.

In the present exemplary embodiment, the transfer roller 73 is the foam roller. For this reason, when the cleaning blade 82 is pressed against the transfer belt 72 with force necessary to scrape off the stain on the transfer belt 72, the transfer roller 73 is compressed. If the compression continues for a long time, an outer diameter of the transfer roller 73 may decrease over time. Then, the cleaning blade 82 is not pressed against the transfer belt 72 with predetermined pressing force, cleaning failure may occur, and the back surface of the sheet may be stained. When $\alpha$ is in a range of 20 degrees to 30 degrees (inclusive), a direction of pressing the transfer roller 73 is far from an axial direction, so that influence on decrease of the outer diameter of the transfer roller 73 is small. It is noted that the reason why data of a being 60 degrees or more is missing is that it is difficult to place the cleaning blade 82 at those angles because of a position of the intermediate transfer belt 30.

From the above, firstly, a may be 20 degrees or more. When α is 20 degrees or more, the stain on the back surface of the sheet can be prevented. α may be 20 degrees or more and 30 degrees or less. When α is in this range, a possibility that the stain may occur over time can be prevented.

Here, a tandem image forming apparatus has been described as an example. Alternatively, the present disclosure may be applied to a transfer unit of a monochrome image forming apparatus, and the transfer unit transfers a toner image from an image carrier, on which a toner image is formed, onto a sheet.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A transfer device comprising:

a first assembly configured to be rotatable around a first rotation shaft, the first assembly comprising an endless belt, and a transfer roller around which the endless belt is wound, the transfer roller being configured to press a sheet against an image transport belt, configured to carry and transport a toner image on a front surface, with the sheet being sandwiched between the image transport belt and the endless belt, so as to transfer the toner image on the image transport belt onto the sheet while rotating;

a second assembly configured to be rotatable around a second rotation shaft, the second assembly comprising a cleaning blade having a plate shape, a leading end edge of the cleaning blade being abutted against a portion of the endless belt where the endless belt is wound around the transfer roller, so as to clean a front surface of the endless belt that is brought into contact with the sheet;

a spring configured to bias the second assembly to rotate around the second rotation shaft so as to press the leading end edge of the cleaning blade against the endless belt; and a moving mechanism configured to move the transfer roller to be in contact with and separated from the image transport belt, wherein the first assembly rotates around the first rotation shaft as the transfer roller moves, and the second assembly follows the rotation of the first assembly by the spring biasing the second assembly, so as to rotate around the second rotation shaft.

2. The transfer device according to claim 1, wherein the first assembly further comprises a tension applying roller wound with the endless belt, the tension applying roller being configured to apply tension on the endless belt, and a first frame configured to rotatably support the transfer roller and the tension applying roller, and the second assembly further comprises a second frame configured to support the cleaning blade and a first end portion of the spring, the transfer device further comprising:

a third frame configured to support a second end portion of the spring, support the first assembly so as to be rotatable around a rotation shaft of the tension applying roller, and rotatably support the second assembly.

3. The transfer device according to claim 2, wherein the second rotation shaft is closer to the image transport belt than the cleaning blade, and the second rotation shaft is rotatably supported by the third frame such that the second assembly rotates around the second rotation shaft.

4. An image forming apparatus comprising:

the transfer device according to claim 3, wherein an image is formed on the sheet by forming the toner image and transferring and fixing the toner image on the sheet.

5. An image forming apparatus comprising:

the transfer device according to claim 2, wherein an image is formed on the sheet by forming the toner image and transferring and fixing the toner image on the sheet.

6. The transfer device according to claim 1, wherein the endless belt is a rubber belt.

7. The transfer device according to claim 6, wherein the transfer roller is a foam roller.

8. An image forming apparatus comprising:

the transfer device according to claim 7, wherein an image is formed on the sheet by forming the toner image and transferring and fixing the toner image on the sheet.

9. An image forming apparatus comprising:

the transfer device according to claim 6, wherein an image is formed on the sheet by forming the toner image and transferring and fixing the toner image on the sheet.

10. The transfer device according to claim 1, wherein the cleaning blade contacts with the endless belt in an angle range of (i) 20 degrees from an origin point toward a downstream side in a rotation direction of the transfer roller to (ii) a phase of a contact point between the endless belt and the image transport belt or the sheet, inclusive, where the origin point is the most upstream point in the rotation direction of the transfer roller in a region where the endless belt contacts with the transfer roller.

11. The transfer device according to claim 10, wherein the phase of the contact point exceeds 30 degrees, and the cleaning blade contacts with the endless belt in an angle range of 20 degrees to 30 degrees from the origin point toward the downstream side, inclusive.

12. An image forming apparatus comprising:

the transfer device according to claim 11, wherein an image is formed on the sheet by forming the toner image and transferring and fixing the toner image on the sheet.

13. An image forming apparatus comprising:

the transfer device according to claim 10, wherein an image is formed on the sheet by forming the toner image and transferring and fixing the toner image on the sheet.

14. An image forming apparatus comprising:

the transfer device according to claim 1, wherein an image is formed on the sheet by forming the toner image and transferring and fixing the toner image on the sheet.

15. A transfer device comprising:

first assembly means that is rotatable around a first rotation shaft, the first assembly means comprising an endless belt, and a transfer roller around which the endless belt is wound, the transfer roller being configured to press a sheet against an image transport belt, configured to carry and transport a toner image on a front surface, with the sheet being sandwiched between the image transport belt and the endless belt, so as to transfer the toner image on the image transport belt onto the sheet while rotating;

second assembly means that is rotatable around a second rotation shaft, the second assembly means comprising a cleaning blade having a plate shape, a leading end edge of the cleaning blade being abutted against a portion of the endless belt where the endless belt is wound around the transfer roller, so as to clean a front surface of the endless belt that is brought into contact with the sheet;

a spring configured to bias the second assembly means to rotate around the second rotation shaft so as to press the leading end edge of the cleaning blade against the endless belt; and moving means for moving the transfer roller to be in contact with and separated from the image transport belt, wherein the first assembly means rotates around the first rotation shaft as the transfer roller moves, and the second assembly means follows the rotation of the first assembly means by the spring biasing the second assembly means, so as to rotate around the second rotation shaft.

* * * * *